US005112539A

United States Patent [19]

Parnet

[11] Patent Number: 5,112,539

[45] Date of Patent: May 12, 1992

[54] BEVERAGE CARBONATING, COOLING AND DISPENSING SYSTEM

[76] Inventor: Dietmar Parnet, R.R. #1, Anderson Road, Kenora, Ontario, Canada, P9N 3W7

[21] Appl. No.: 471,511

[22] Filed: Jan. 29, 1990

[51] Int. Cl.[5] ..... B01F 3/04

[52] U.S. Cl. ..... 261/128; 261/119.1; 261/DIG. 7; 62/457.2; 62/457.4; 62/400

[58] Field of Search ..... 261/DIG. 7, 128, 119.1; 62/457.2, 457.4, 400

[56] References Cited

U.S. PATENT DOCUMENTS

| | | | |
|---|---|---|---|
| 1,081,019 | 12/1913 | Conwell | 261/DIG. 7 |
| 1,503,107 | 7/1924 | Bastian . | |
| 1,681,110 | 8/1928 | Friedman | 62/457.5 |
| 1,885,678 | 11/1932 | Boyer | 261/DIG. 7 |
| 2,514,463 | 7/1950 | Bayers, Jr. | 261/DIG. 7 |
| 3,069,869 | 12/1962 | Mueller | 62/457.2 |
| 3,472,425 | 10/1969 | Booth et al. . | |
| 3,578,295 | 5/1971 | Hudson | 261/DIG. 7 |
| 3,802,220 | 4/1974 | Pompo . | |
| 3,926,342 | 12/1975 | Selvia et al. | 261/DIG. 7 |
| 4,024,731 | 5/1977 | Branscum . | |
| 4,265,376 | 5/1981 | Skidell | 261/DIG. 7 |
| 4,336,883 | 6/1982 | Krug et al. | 62/457.2 |
| 4,343,824 | 8/1982 | Caldwell . | |
| 4,457,877 | 7/1984 | Love et al. . | |
| 4,633,678 | 1/1987 | Lea et al. | 62/400 |
| 4,636,337 | 1/1987 | Gupta et al. . | |
| 4,676,283 | 6/1987 | Caldwell . | |
| 4,764,315 | 8/1988 | Brusa | 261/DIG. 7 |
| 4,771,911 | 9/1988 | Morony et al. . | |
| 4,782,945 | 11/1988 | Geiler et al. . | |

FOREIGN PATENT DOCUMENTS

| | | | |
|---|---|---|---|
| 2133302 | 3/1984 | United Kingdom | 261/DIG. 7 |

*Primary Examiner*—Tim Miles

[57] ABSTRACT

A method and device is provided for carbonating water or a beverage with a minimum of carbon dioxide gas and operating steps. A temporary connection of a regulated gas supply to a container tank is used for the period of time required to carbonate and saturate the water or beverage. After the liquid is saturated with the gas and carbonated, the gas supply hose is disconnected. The size of the container tank is restricted to the overall weight of the combined unit if it is to be used on a portable basis. Larger amounts of liquid can be carbonated with this method, if the carbonating and dispensing set up is in a stationary, permanent location. The portable container tank is cooled by ice packs or cooling coils and air contact with the tank is kept to a minimum by providing an insulating carry container which encloses the container tank and cooling means. The internal gas pressure is used for dispensing of the liquid land the container tank is recharged, repressurized if it should become necessary for the discharging of all the liquid.

6 Claims, 5 Drawing Sheets

BEVERAGE CARBONATING, COOLING AND DISPENSING SYSTEM

BACKGROUND OF THE INVENTION

This invention relates to a beverage carbonating, cooling, and dispensing system.

At present portable drink containers like cooler jugs and insulated barrels are used for cooling and dispensing of non carbonated water and non carbonated beverages. Pumps, push button and lever type outlet taps are used for dispensing. Generally, the cooling of the water or beverage is achieved by adding ice to it.

Soda water, produced by carbonation is easily turned into an effervescing soft drink by adding fruit juices or natural flavours and sweeteners to it either prior to or subsequent to carbonation.

The popularity of carbonated water and carbonated soft drinks has led to a tremendous growth of the soft drink industry.

The vast majority of soft drinks are supplied premixed in containers for home use. Colas and other fruit drink groups are manufactured and shipped to bottling and canning plants where the syrup is diluted with water carbonated and bottled. The quality of water used, control of the ingredients and the product is entirely in the hands of the manufacturer. However, artificial sweeteners, flavours, colours etc. are not favoured by the growing health conscious consumer group.

Beverage dispensing units in commercial establishments use one carbon dioxide gas cylinder to discharge three or four container cylinders. The containers are filled with a carbonated water, drink mixture, like "Cola" or other brand name beverages. The containers are connected with plastic hoses to a gas cylinder equipped with an output pressure regulator and the beverage containers are pressurized at between thirty and seventy pounds p.s.i.

All output hoses lead to a small dispensing cabinet that incorporates a driptray and labeled output taps. The long hoses between containers and output taps make additional cooling necessary. This is achieved by the use of electric compressor cooling units or by leading the hoses through ice trays.

This beverage dispensing set up lacks portability and is mainly used in a stationary setting where the hoses from the gas cylinder to the drink containers and the hoses from the drink containers to the dispensing cabinet can be hidden under desks and table tops.

Previous art indicates that other portable or home units for carbonating beverages are available but these have the disadvantage that the use of small gas supplies in one-shot dispensers, such as bulbs, restricts the volume of liquid that can be carbonated and causes significant costs for the gas which lead to a reduction in the economics. In other cases technically complicated designs and operating steps needed for the production make the devices difficult to operate and unattractive to the consumer.

SUMMARY OF THE INVENTION

According to a first aspect of the invention there is provided an apparatus for carbonating and dispensing a beverage liquid comprising a tank, a filler opening, means for sealing the filler opening, a gas inlet valve on the tank for temporary connection of a supply of carbon dioxide, a liquid discharge opening having a valve for controlling flow of liquid therethrough, means for manual carrying of the tank, a portable insulating carry container into which the tank can be positioned and means in said container for cooling said tank and said liquid therein.

According to a second aspect of the invention there is provided a method for producing a carbonated beverage comprising introducing into a tank a liquid to be carbonated, applying to the tank a supply of carbon dioxide gas which is applied at a preselected pressure and flows through a regulator, pressuring the tank for period of time sufficient to dissolve the gas in the liquid such that the liquid is saturated with the gas, disconnecting the gas supply and discharging on demand the carbonated beverage from the tank.

By providing the outlet tap right at the container tank and by cooling the container tank with refreezable ice packs or a small compressor type cooling unit, long gas input hoses and long beverage output hoses are not needed.

Carbonated water and carbonated beverages lose their carbonation after the tin or bottle has been opened. Therefore the bottles and tins are kept small to assure a quick consumption of the drink before the drink becomes flat.

The higher gas pressure which can be employed in the present invention keeps the content carbonated regardless of how little is used and the content is kept sterile by not allowing air to make contact with it.

Throwaway bottles and tins are a tremendous waste and present a major concern about quickly filling landfill and waste-disposal sites. By employing the present invention as a portable reusable soda water dispensing unit, bottle and can litter and container waste can be reduced.

In the prior art portable soda water dispensing systems, small gas cartridges, small gas amounts in an expensive package, provided the carbon dioxide gas. This resulted in high beverage and water carbonation costs and lack of flexibility in the operating steps. I have found this disadvantage may be overcome by the use of a larger volume of gas for the beverage and water carbonating process.

By using the regular gas container cylinders which hold 50 pounds of gas, or by using the smaller ones which hold 30 pounds, 20 pounds or less, the home water and beverage carbonation becomes economical and provides savings to the consumer.

Another advantage over prior art portable soda water dispensers is, that a gas supply cylinder is not needed for the dispensing of the carbonated beverage and water under pressure. The gas supply cylinder for carbonation can be disconnected when the carbonation is complete.

Thus, the gas supply cylinder is needed only for the carbonation of the liquid and for the recharging, pressurizing of the container tank.

The primary object of this invention is to provide the means to produce carbonated water and carbonated beverages as well as beverage dispensing and beverage mixing to the consumer.

Another object of this invention is to give the user the means of producing carbonated beverages with the type and quality of water and ingredients of choice.

Another object of this invention is to provide the user with the means to produce economical, less costly, effervescing beverages.

A further object of this invention is to provide a portable, reusable beverage cooler and soda fountain as an alternative to bottled and canned drinks.

Still another object of this invention is to provide the user with an easy, compact water carbonator and beverage dispenser which can be used on a mobile and portable basis and can be easily installed or incorporated into: Kitchens, bars, boats, camper units etc.

These objects and other advantages of the invention will become apparent from a study of the following specifications and drawings.

With the foregoing in view, and other advantages as will become apparent to those skilled in the art to which this invention relates a this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
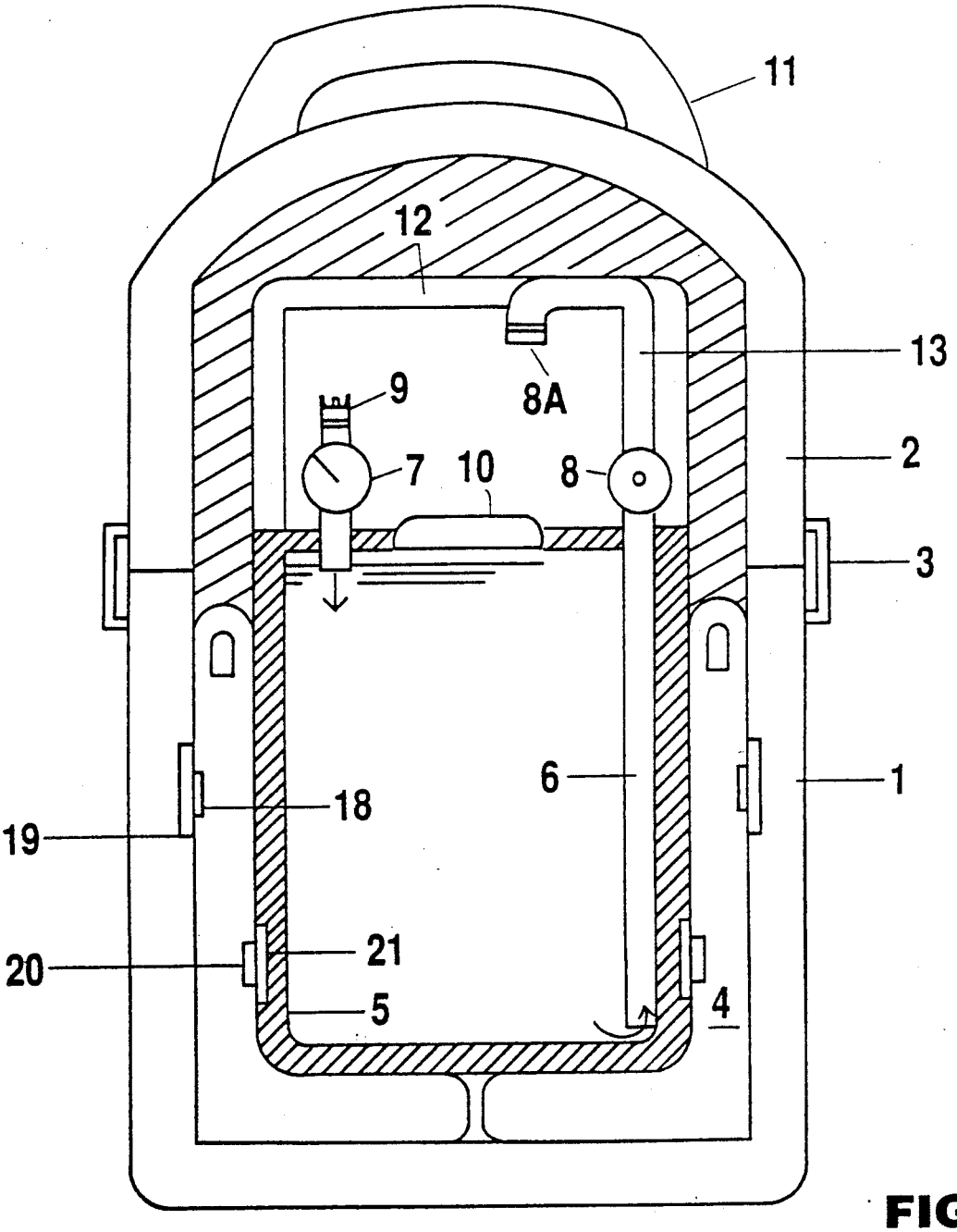
FIG. 1 is a cross-sectional view through an apparatus according to the invention.

The external features of the water carbonator cooler and drink dispenser are shown in FIG. 1.

The insulating carry container 1 is covered with a dome shaped cover 2 which can be locked into position in a closed sealing relationship by over-center latches 3. By holding the cover at handle 11 on top of the cover 2 the cover is then unlocked and lifted off the container. This now gives full access to a container tank 5 mounted within the carry container. By holding the container tank at the carry frame 12 thereof, the container tank is then lifted out of a plurality of surrounding ice packs 4.

Then the ice packs are removed and placed in a freezer to freeze them for later use. After opening a sealable lid assembly 10 at the top of the tank, the tank is filled with cold water or beverage and the lid is closed tight.

The carry container 1 is now refitted with frozen ice packs and the pressure tank 5 is inserted back into the carry container. The ice packs provide the cooling for the water or beverage. After checking that an outlet tap valve 8 is closed, a gas-supply hose with connector is attached to a gas inlet valve 9 on the container tank 5.

Figure 3:
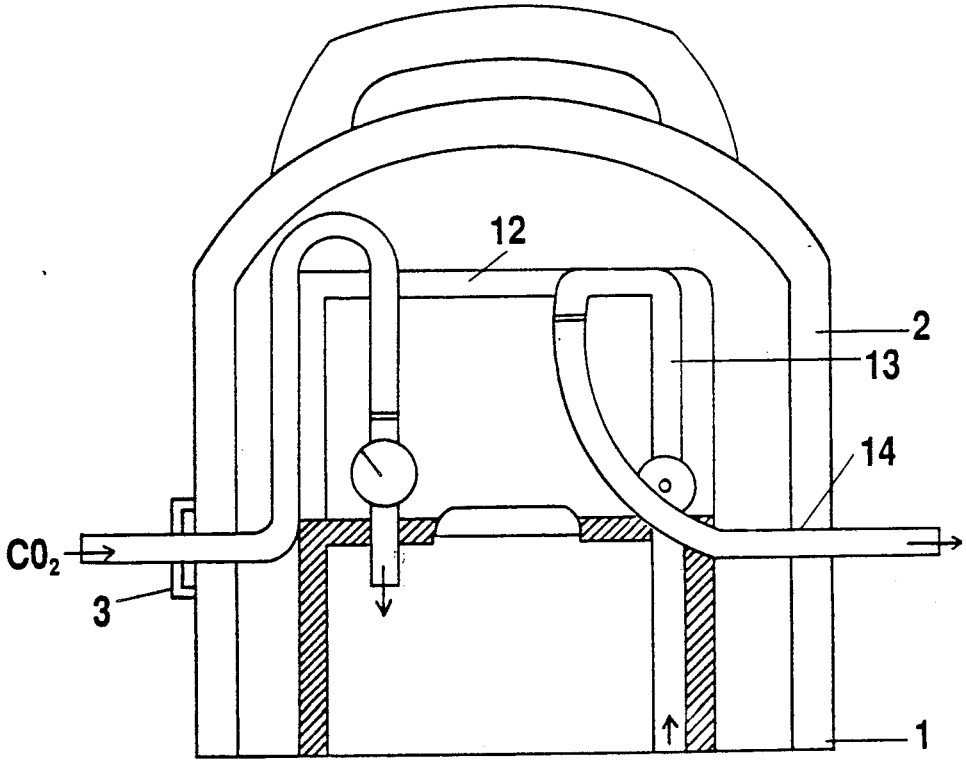
FIG. 3 is a cross-sectional view similar to FIG. 1 showing the device of FIG. 1 when used for charging or for discharging in a stationary setting.
Figure 4:
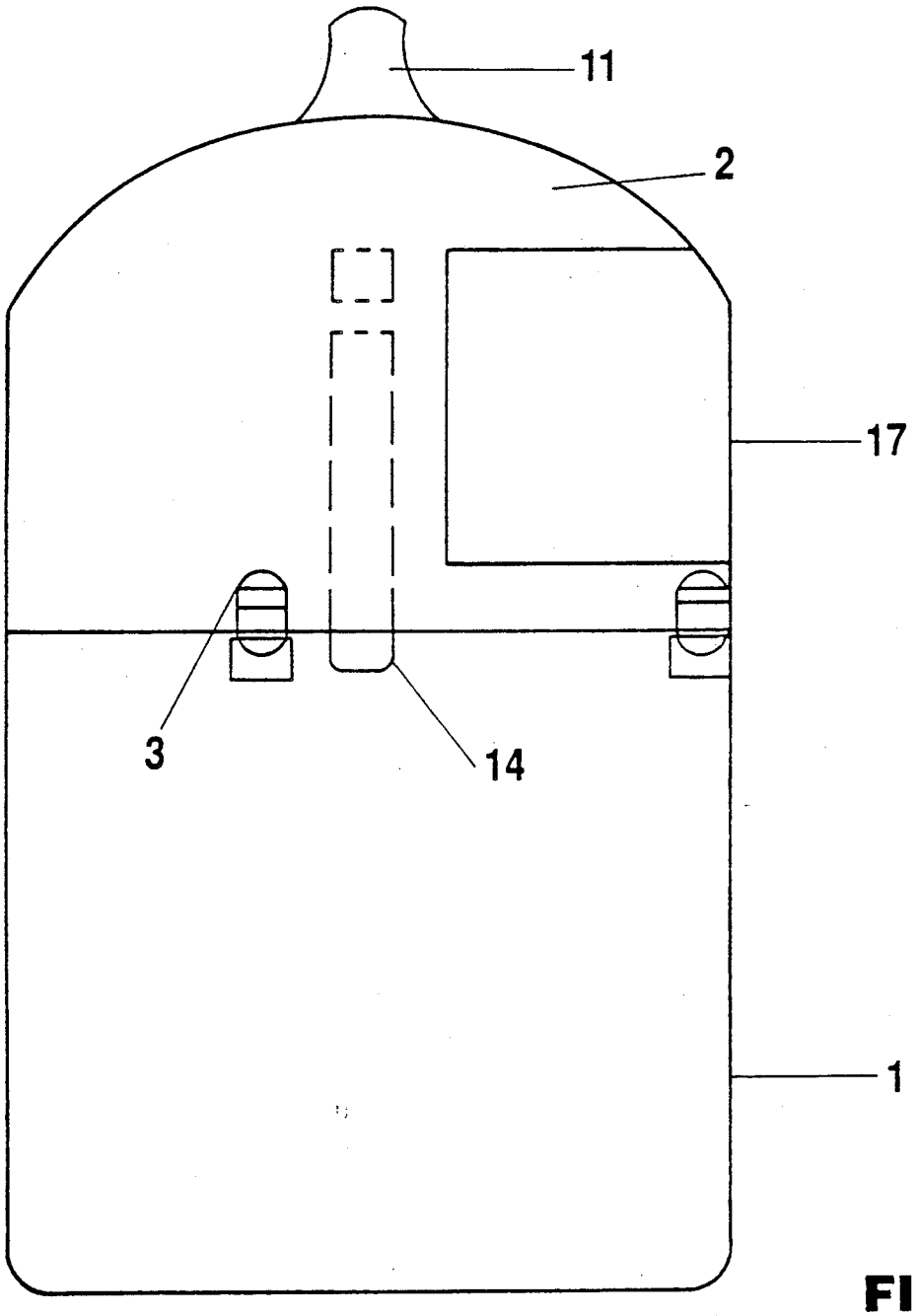
FIG. 4 is a side elevational view of the apparatus of FIG. 1.

The carbon dioxide gas hose is fed through one of the U-shaped openings 14 located in the top rim of carry container 1 as shown in FIG. 3 if the cover top 2 is to be attached.

Carbon dioxide gas, regulated down to 100 p.s.i. pressure is now injected into the container tank by opening the valve on the gas container cylinder slightly.

A tank pressure gauge 7 indicates the rise in pressure and the gas flow slows down when the 100 pounds pressure is reached. The pressure is constant for the carbonation time. A lower gas pressure may also be used but it would extend the water carbon dioxide absorption time and it would lower to some degree the amount of gas that can be dissolved in the water.

After the carbonation time, which may be between 15 to 30 hours, the gas supply valve is closed and the hose is disconnected from the pressure tank by uncoupling the gas inlet valve connection 9. The container tank now contains soda water under a pressure of 100 pounds as indicated by gauge 7.

The water and beverage carbonator cooler and dispenser is now ready for use, the cover 2 is reattached to base container 1 and the unit is carried by the handle 11 at the top of the cover.

The insulating carry container 1 is lined with three to four sections of rigid, refreezable ice packs 4 spaced around the periphery of the tank. Each ice pack is fitted with two magnets 18 and 20 for attachment to the carry container 1 and to the tank 5 to locate the packs in position.

The dome shaped insulating container cover 2 is attached to container 1 by three clamps 3. Carry handle 11 is centered on top of the carry container cover 2.

The container tank 5 is fitted with a syphon outlet pipe 6, a pressure gauge 7, an outlet tap valve 8, an outlet tap 8A, a gas inlet valve 9, a tank filler opening with lid assembly 10 and a rigid carry frame 12, and is surrounded by the freezer packs 4.

Figure 2:
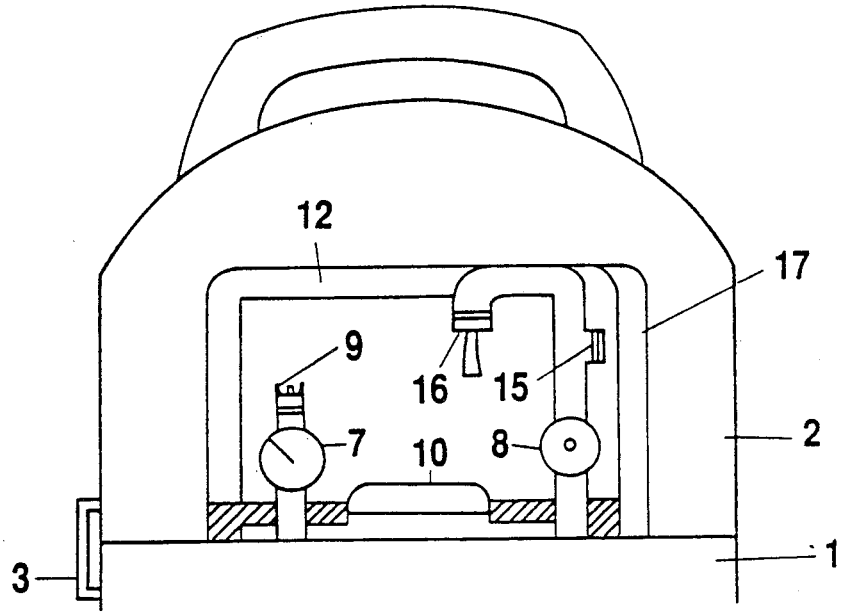
FIG. 2 is a cross-sectional view similar to FIG. 1 showing an upper part of a modified device.

The outlet pipe 13 is lined up with and attached to the carry frame 12. The container tank is fitted with three to four steel plates 21 which hold the tank in place and prevent the tank from turning around, by interlocking with ice pack magnets 20. The ice pack magnets 18 interlock with the steel plates 19 securing the ice packs inside the container wall. FIG. 2 shows a lever type outlet tap 16 and an output hose connector 15 is added. The connector and valve are mounted on the carry frame 12 and connect to the syphon tube 6 which forms part of the carry frame.

In FIG. 2 is shown an access door 17 which can be opened or removed to provide access to the lever type outlet tap 16 and outlet tap valve 8 without removing the cover 2.

FIG. 3 shows the beverage hose connections and routing if a stationary setting should require the employment of hoses. With the access door closed the hoses are led through the U-shaped openings located in the top rim of container 1. The openings 14 are opposite each other and are closed by a sealing element (not shown) when not needed. The cover access door is also closed during transport and stand by time, especially in a hot environment.

A point alignment system can be used to allow for the correct positioning of the cover onto the carry container. The container tank 5 is secured by a locking device or magnets to prevent turning.

Figure 5:
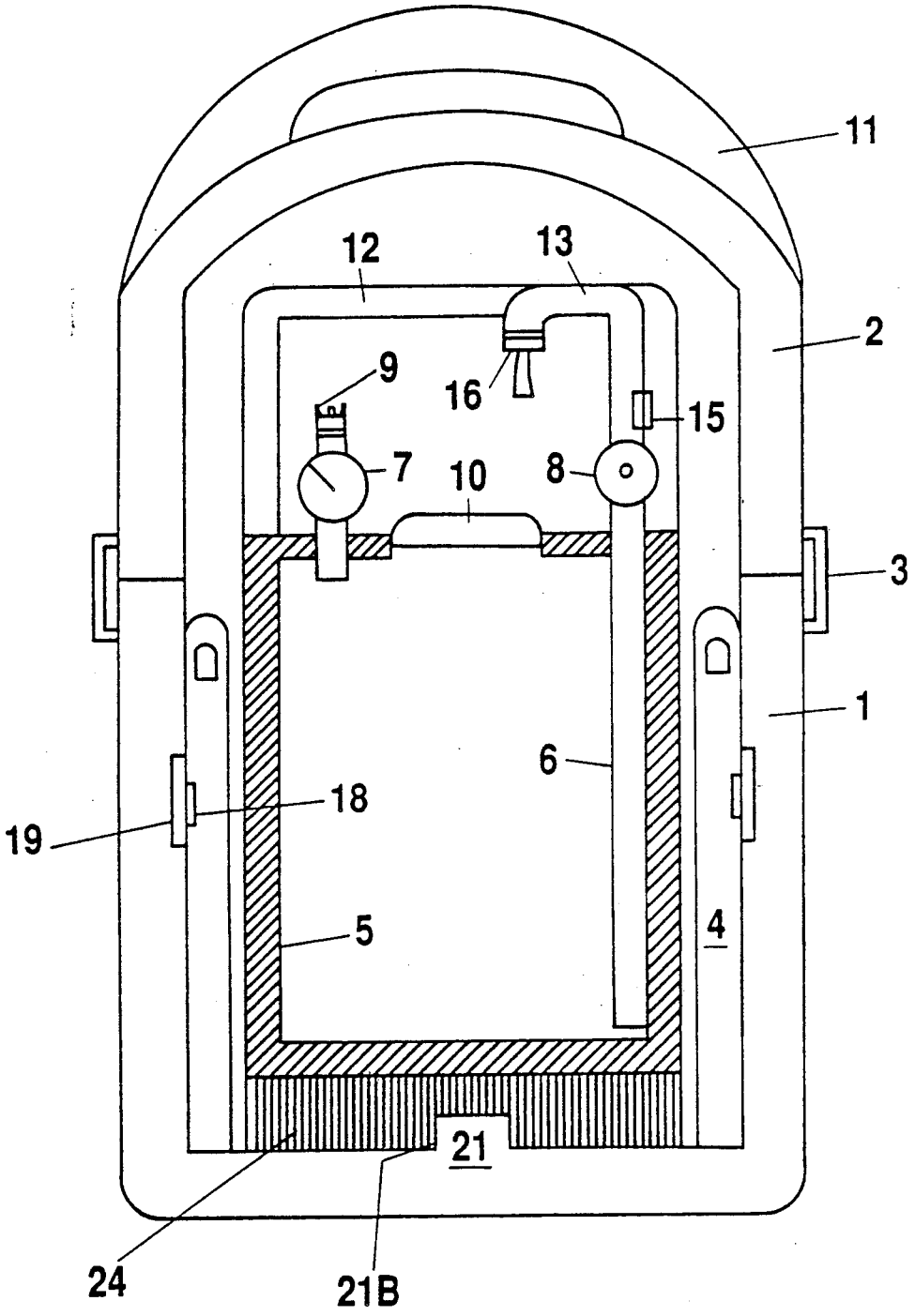
FIG. 5 is a cross-sectional view similar to FIG. 1 showing an alternative arrangement.

FIG. 5 shows a modified arrangement of a cross-sectional view of a beverage-water carbonator, cooler and dispensing device.

In this arrangement, the carbonator container tank is fitted with a base 24 made of slightly shock absorbing and dent free material like hard rubber. A track having a groove 21B is centered across the base exterior and a cooperating stacking rail 21 is centered across the carry container base interior.

Figure 6:
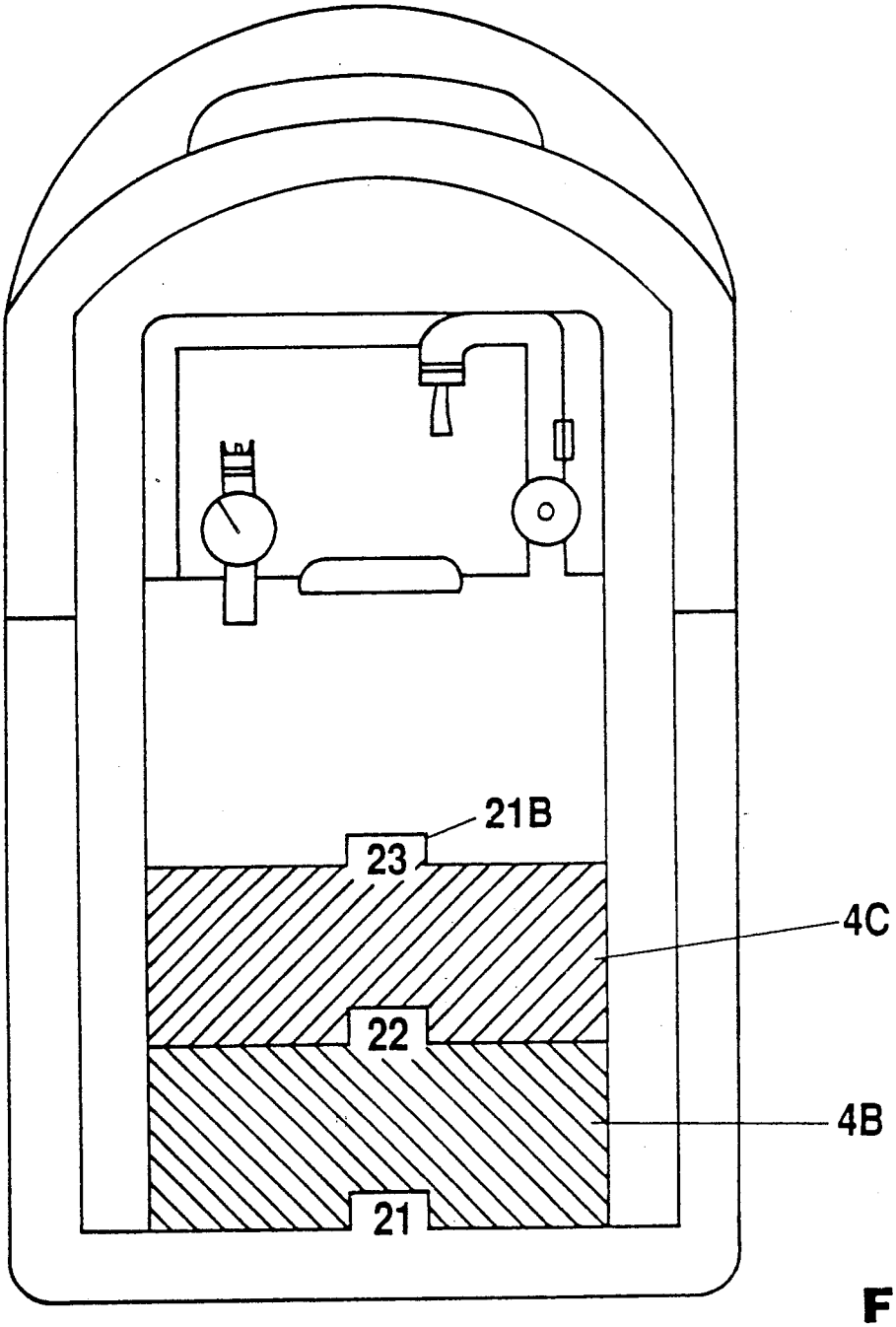
FIG. 6 is a cross-sectional view similar to FIG. 5 showing the use of a smaller tank and space filler elements in the container of FIG. 5.

FIG. 6 is a cross-sectional view of a further modified arrangement of a beverage-water carbonator, cooler and dispensing device where interlocking space filler packs provide the means to use a large carry container in conjunction with a smaller carbonator container tank. The space filler packs 4B and 4C have top stacking rails 22 and 23 which fit into the track having a groove inside the container tank base and inside the space filler pack base.

The stacking rail of the space filler pack is designed for easy grip and incorporates a filler opening with lid. A marker line on the semi transparent material indicates the maximum fill level to allow for expansion of the content if the space filler pack is frozen and used for additional cooling.

The embodiments of the present invention described above have the following advantages:

(1) By placing the carbonator container tank into an insulating carry container in which cooling is provided by means of ice packs or even a small electrically operated compressor unit, the carbonator, cooler and dispensing unit is improved in compactness and portability.

(2) By fitting the carbonator container tank with an output tap and by use of the internal gas pressure for the discharging of the liquid, no beverage hoses are needed.

(3) By providing simple interlocking methods, the carbonator container tank, ice packs and space filler packs are easily exchanged.

(4) By employing the slow carbonation method, the equipment and operating steps are kept very simple and a larger amount of water or beverage can be carbonated with less gas.

(5) By using a larger gas supply, five to fifty pounds, a less costly carbonated beverage or carbonated water is produced.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for carbonating and dispensing a beverage liquid comprising a tank, a filler opening, means for sealing the filler opening, a gas inlet valve on the tank for temporary connection of a supply of carbon dioxide, a liquid discharge duct having an opening and a valve for controlling flow of liquid therethrough, output hose connector means and handle means for manual carrying of the tank, a portable insulating carry container into which the tank can be positioned and means in said container for cooling said tank and said liquid therein, said handle means incorporating said liquid discharge duct with said opening and valve mounted on said handle means.

2. Apparatus as claimed in claim 1 wherein air contact with the tank is kept to a minimum by a tight fitting cover lid on said carry container which has a top carry handle and an access opening with a fitting access door cover which is opened to gain access to the discharge duct and valve and to the gas inlet valve for the dispensing of the liquid content.

3. Apparatus for carbonating and dispensing a beverage liquid comprising a tank, a filler opening, means for sealing the filler opening, a gas inlet valve on the tank for temporary connection of a supply of carbon dioxide, a liquid discharge duct having an opening and a valve for controlling flow of liquid therethrough, output hose connector means and handle means for manual carrying of the tank, a portable insulating carry container into which the tank can be positioned and means in said container for cooling said tank and said liquid therein wherein the carry container includes two U-shaped openings inside a top rim of the carry container, said openings having closure means which can be opened should a stationary set up require the employment of a flexible gas inlet hose and a flexible discharge hose.

4. Apparatus for carbonating and dispensing a beverage liquid comprising a tank, a filler opening, means for sealing the filler opening, a gas inlet valve on the tank for temporary connection of a supply of carbon dioxide, a liquid discharge duct having an opening and a valve for controlling flow of liquid therethrough, output hose connector means and handle means for manual carrying of the tank, a portable insulating carry container into which the tank can be positioned and means in said container for cooling said tank and said liquid therein the carry container having a base wall defining an upper surface onto which the tank is placed and a stacking rail across the surface of the base wall inside the carry container, the tank including a groove to interlock with the stacking rail for the correct alignment and to prevent the tank from turning.

5. Apparatus as claimed in claim 4 including a space filler element for mounting in the carry container, the element having a rail to interlock with the tank.

6. Apparatus for carbonating and dispensing a beverage liquid comprising a tank, a filler opening, means for sealing the filler opening, a gas inlet valve on the tank for temporary connection of a supply of carbon dioxide, a liquid discharge duct having an opening and a valve for controlling flow of liquid therethrough, output hose connector means and handle means for manual carrying of the tank, a portable insulating carry container into which the tank can be positioned and means in said container for cooling said tank and said liquid therein wherein the cooling means comprises a plurality of ice packs mounted within the carry container and removable therefrom and arranged to surround the tank when inserted into the carry container, each of the ice packs including a magnetic latch mechanism for cooperation with a latch portion inside the carry container.

* * * * *